US006858127B2

(12) United States Patent
Hoek et al.

(10) Patent No.: US 6,858,127 B2
(45) Date of Patent: Feb. 22, 2005

(54) PROCESS FOR THE PREPARATION OF MIDDLE DISTILLATES

(75) Inventors: Arend Hoek, Amsterdam (NL); Matthijs Maria Gerardus Senden, Amsterdam (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/469,843

(22) PCT Filed: Mar. 1, 2002

(86) PCT No.: PCT/EP02/02336

§ 371 (c)(1),
(2), (4) Date: Sep. 4, 2003

(87) PCT Pub. No.: WO02/070628

PCT Pub. Date: Sep. 12, 2002

(65) Prior Publication Data

US 2004/0074810 A1 Apr. 22, 2004

(30) Foreign Application Priority Data

Mar. 5, 2001 (EP) ..... 01400562
Sep. 28, 2001 (EP) ..... 01308293

(51) Int. Cl.[7] ..... C10G 65/00; C10G 47/00; C10G 35/00; C07C 27/00

(52) U.S. Cl. ..... 208/59; 208/58; 208/107; 208/108; 208/133; 518/700; 518/715

(58) Field of Search ..... 518/700, 715; 208/58, 59, 107, 108, 133

(56) References Cited

U.S. PATENT DOCUMENTS

| | | | | |
|---|---|---|---|---|
| 4,857,559 | A | 8/1989 | Eri et al. | |
| 5,689,301 | A | 11/1997 | Christopher et al. | |
| 5,785,862 | A | 7/1998 | Graham et al. | |
| 6,204,426 | B1 | 3/2001 | Miller et al. | |
| 2003/0019788 | A1 * | 1/2003 | Benazzi et al. | 208/57 |

FOREIGN PATENT DOCUMENTS

| | | | |
|---|---|---|---|
| AU | 698392 | 10/1998 | C01G/49/14 |
| EP | 0161705 | 4/1989 | C07C/11/02 |
| EP | 0321305 | 6/1989 | C10G/45/62 |
| EP | 0426223 | 5/1991 | F01L/3/20 |
| EP | 0532116 | 3/1993 | C10G/47/14 |
| EP | 0532118 | 3/1993 | C10G/47/14 |
| EP | 0583836 | 2/1994 | C10G/65/12 |
| EP | 1004746 | 5/2000 | E21B/43/00 |
| WO | 99/01218 | 1/1999 | B10J/23/847 |
| WO | 99/34917 | 7/1999 | B01J/23/75 |
| WO | 01/83641 | 11/2001 | |

OTHER PUBLICATIONS

International Search Report dated Apr. 11, 2003.

* cited by examiner

*Primary Examiner*—J. Parsa

(57) ABSTRACT

A process for the preparation of one or more hydrocarbon fuel products boiling in the kero/diesel range from a stream of hydrocarbons produced in a Fischer-Tropsch process, in which process synthesis gas is converted into liquid hydrocarbons, at least a part of the hydrocarbons boiling above the kero/diesel range, having the following steps:

(1) hydrocracking/hydroisomerizing at least a part of the Fischer-Tropsch hydrocarbons stream at a conversion per pass of at most 80 wt % of the material boiling above 370° C. into material boiling below 370° C.;

(2) separating the product stream obtained in step (1) into one or more light fractions boiling below the kero/diesel boiling range, one or more fractions boiling in the kero/diesel boiling range and a heavy fraction boiling above the kero/diesel boiling range;

(3) hydrocracking/hydroisomerizing the major part of the heavy fraction obtained in step (2) at a conversion per pass of at most 80 wt % of the material boiling above 370° C. into material boiling below 370° C.;

(4) separating the product stream obtained in step (3) into one or more light fractions boiling below the kero/diesel boiling range, one or more fractions boiling in the kero/diesel boiling range and a heavy fraction boiling above the kero/diesel boiling range; and, (5) hydrocracking/hydroisomerizing the major part of the heavy fraction obtained in step (4) in the hydrocracking/hydroisomerizing process described in step (1) and/or step (3), in which process the Fischer-Tropsch hydrocarbons stream comprises at least 35 wt % $C_{30}$+ (based on total amount of hydrocarbons in the Fischer-Tropsch hydrocarbons stream) and in which stream the weight ratio $C_{60}$+/$C_{30}$+ is at least 0.2.

17 Claims, No Drawings

PROCESS FOR THE PREPARATION OF MIDDLE DISTILLATES

FIELD OF THE INVENTION

The present invention relates to a process for the preparation of one or more hydrocarbon fuel products boiling in the kero/diesel range from a stream of hydrocarbons produced in a Fischer-Tropsch process and to hydrocarbons so produced.

BACKGROUND OF THE INVENTION

Today the energy requirements of the transport sectors are dominated by liquid fuels derived from the fractionation and processing of crude oil. The dominance of liquid fuels is expected to continue.

Crude oils derived from liquid fuels usually are not clean. They typically contain significant amounts of sulphur, nitrogen and aromatics. Diesel fuels derived from crude oil show relatively low cetane values. Clean distillate fuels can be produced from petroleum based distillates through (severe) hydrotreatment at great expense. For diesel fuels, however, these treatments usually hardly improve the cetane number.

Another source for distillate fuels, especially middle distillates, i.e. kerosene and diesel, is the Fischer-Tropsch process, especially using cobalt catalysts. During the last two decades this process has evolved as a key process for the conversion of natural gas into especially middle distillates of high quality. In this process synthesis gas is converted in several steps into middle distillates. First, natural gas in converted into synthesis gas by means of a (catalytic) partial oxidation process and/or steam reforming process. In a second step the synthesis gas is converted into long chain paraffins (the average $C_5$+ hydrocarbon usually comprising 25 to 35 carbon atoms). In a third step the long chain hydrocarbons are hydrocracked into molecules of the desired middle distillate fuels. In this respect reference is made to EP 161 705, EP 583 836, EP 532 116, WO 99/01218, U.S. Pat. No. 4,857,559 and EP 1 004 746. Further reference is made to H M H van Wechem and M M G Senden, Conversion of Natural Gas to Transportation Fuels, Natural Gas Conversion II, H E Curry-Hyde and R F Howe (editors), Elsevier Science B.V. pages 43–71.

In general, the quality of the middle distillates prepared by the Fischer-Tropsch process is excellent. The mainly paraffinic products are free from sulphur, nitrogen and aromatic compounds. The kerosene and diesel have excellent combustion properties (smoke point and cetane number). The cold flow properties meet the relevant specifications. If necessary, additives may be used to meet the most stringent cold flow specifications. In addition, also the usual additives may be added.

In view of the continuously increasing requirements of the middle distillate properties, there is a need to further improve the middle distillate properties, especially the cold flow properties of the middle distillates. Thus, there is a need for middle distillates with improved intrinsic cold flow properties, i.e. these properties are to be obtained without using any further treatment of the fuels (e.g. dewaxing) or without the use of any additives. In addition, for the diesel fraction it is desired that T95, the temperature at which 95 vol % amount of diesel boiling, is 380° C. or less, preferably 370° C. or less, more preferably 360° C. or less, the density (15° C.) should be 840 kg/m$^3$ or less, preferably 800 kg/m$^3$ or less, more preferably 780 kg/m$^3$ or less and the amount of (poly)aromatic compounds should be zero.

SUMMARY OF THE INVENTION

It has now been found that hydrocracking/hydroisomerising a relatively heavy Fischer-Tropsch hydrocarbon product (a $C_5$+ product, preferably a $C_{10}$+ product) at a relatively low conversion per pass rate, i.e. less than 80% conversion of a fraction boiling above a certain boiling point (e.g. 370° C.) which is fed into the reactor into a fraction boiling below that boiling point, and subjecting most of the material boiling above the kero/diesel boiling range to a second, similar hydrocracking/hydroisomerising reaction followed by a recycle of the main part of the material boiling above the kero/diesel boiling range to a hydrocracking/hydroisomerising reaction, results in middle distillates showing exceptionally good cold flow properties, making any further treatment (to improve the cold flow properties) and/or the use of additives in principle superfluous. Compared with Fischer-Tropsch product which is less heavy (for example the amount of $C_{30}$+ is e.g. 10% wt less) the cold flow properties (pour point, CFPP) may be 5 or even 10° C. better. In addition, T95, density and (poly)aromatic content satisfy the ranges as mentioned above. The process is preferably carried out in a continuous way.

DETAILED DESCRIPTION OF THE INVENTION

The process of the present invention results in middle distillates having exceptionally good cold flow properties. These excellent cold flow properties could perhaps be explained by the relatively high ratio iso/normal and especially the relatively high amount of di- and/or trimethyl compounds. Nevertheless, the cetane number of the diesel fraction is more than excellent at values far exceeding 60, often values of 70 or more are obtained. In addition, the sulphur content is extremely low, always less than 50 ppmw, usually less than 5 ppmw and in most case the sulphur content is zero. Further, the density of especially the diesel fraction is less than 800 kg/m$^3$, in most cases a density is observed between 765 and 790 kg/m$^3$, usually around 780 kg/m$^3$ (the viscosity for such a sample being about 3.0 cSt). Aromatic compounds are virtually absent, i.e. less than 50 ppmw, resulting in very low particulate emissions. The polyaromatic content is even much lower than the aromatic content, usually less than 1 ppmw. T95, in combination with the above properties, is below 380° C., often below 350° C.

The process as described above results in middle distillates having extremely good cold flow properties. For instance, the cloud point of any diesel fraction is usually below −18° C., often even lower than −24° C. The CFPP is usually below −20° C., often −28° C. or lower. The pour point is usually below −18° C., often below −24° C.

Due to the relatively heavy Fischer-Tropsch product which is used in the process, the overall conversion of the process is extremely high. This holds for the carbon conversion as well as for the thermal conversion. The carbon conversion for the Fischer-Tropsch process and the hydrocracking/hydro-isomerising reaction is above 80%, preferably above 85%, more preferably above 90%. The thermal conversion for the process will be above 70%, preferably is above 75%, more preferably is above 80%. It is an extremely advantageous situation that such high conversions can be coupled with the extremely good product properties. In addition, the selectivity to $C_5$+ hydrocarbon is usually above 85 wt %, preferably above 90 wt %, of all hydrocarbons made in the Fischer-Tropsch process.

The kero/diesel boiling range in general may vary slightly, depending on local conditions, availability of specific feed streams and specific practices in refineries, all well known to the man skilled in the art. For the purposes of this specification the kero/diesel boiling range suitably has an initial boiling point between 110 and 130° C., preferably at least 140, more preferably at least 150° C., still more preferably at least 170° C. The final boiling point for the purposes of this specification is suitably between 400 and 410° C., preferably at most 390° C., more preferably at most 375° C., still more preferably at most 360° C. The end of the kerosene boiling range may be up to 270° C., usually up to 250° C., but may also be up to 220° C. or even 200° C. The start of the diesel boiling range may be 150° C., is usually 170° C. but may also be 190° C. or even above 200° C. The 50% recovered temperature of the diesel fraction is preferably between 255 and 315° C., preferably between 260 and 300° C., more preferably around 285° C.

It will be appreciated that the one or more hydrocarbon fuel products of the present invention suitable is a full range boiling product in the diesel/kero range as defined above, but also very suitably may be two fractions, one boiling in the diesel range, the other boiling in the kerosene range. In addition, three or more fractions, for instance a kerosene fraction, a light diesel fraction and a heavy diesel fraction, may be considered as a commercially attractive option. In principle, the number of fractions and the boiling ranges will be determined by operational and commercial conditions.

The synthesis gas to be used for the Fischer-Tropsch reaction is made from a hydrocarbonaceous feed, especially by partial oxidation and/or steam/methane reforming. The hydrocarbonaceous feed is suitably methane, natural gas, associated gas or a mixture of $C_{1-4}$ hydrocarbons, especially natural gas.

To adjust the $H_2/CO$ ratio in the syngas, carbon dioxide and/or steam may be introduced into the partial oxidation process. The $H_2/CO$ ratio of the syngas is suitably between 1.3 and 2.3, preferably between 1.6 and 2.1. If desired, (small) additional amounts of hydrogen may be made by steam methane reforming, preferably in combination with the water gas shift reaction. The additional hydrogen may also be used in other processes, e.g. hydrocracking.

In another embodiment the $H_2/CO$ ratio of the syngas obtained in the catalytic oxidation step may be decreased by removal of hydrogen from the syngas. This can be done by conventional techniques as pressure swing adsorption or cryogenic processes. A preferred option is a separation based on membrane technology. Part of the hydrogen may be used in the hydrocracking step of especially the heaviest hydrocarbon fraction of the Fischer-Tropsch reaction.

The synthesis gas obtained in the way as described above, usually having a temperature between 900 and 1400° C., is cooled to a temperature between 100 and 500° C., suitably between 150 and 450° C., preferably between 300 and 400° C., preferably under the simultaneous generation of power, e.g. in the form of steam. Further cooling to temperatures between 40 and 130° C., preferably between 50 and 100° C., is done in a conventional heat exchanger, especially a tubular heat exchanger. To remove any impurities from the syngas, a guard bed may be used. Especially to remove all traces of HCN and/or $NH_3$ specific catalysts may be used. Trace amounts of sulphur may be removed by an absorption process using iron and/or zinc oxide.

The purified gaseous mixture, comprising predominantly hydrogen, carbon monoxide and optionally nitrogen, is contacted with a suitable catalyst in the catalytic conversion stage, in which the normally liquid hydrocarbons are formed.

The catalysts used for the catalytic conversion of the mixture comprising hydrogen and carbon monoxide into hydrocarbons are known in the art and are usually referred to as Fischer-Tropsch catalysts. Catalysts for use in this process frequently comprise, as the catalytically active component, a metal from Group VIII of the Periodic Table of Elements. Particular catalytically active metals include ruthenium, iron, cobalt and nickel. Cobalt is a preferred catalytically active metal in view of the heavy Fischer-Tropsch hydrocarbon which can be made. As discussed before, preferred hydrocarbonaceous feeds are natural gas or associated gas. As these feedstocks usually results in synthesis gas having $H_2/CO$ ratio's of about 2, cobalt is a very good Fischer-Tropsch catalyst as the user ratio for this type of catalysts is also about 2.

The catalytically active metal is preferably supported on a porous carrier. The porous carrier may be selected from any of the suitable refractory metal oxides or silicates or combinations thereof known in the art. Particular examples of preferred porous carriers include silica, alumina, titania, zirconia, ceria, gallia and mixtures thereof, especially silica, alumina and titania.

The amount of catalytically active metal on the carrier is preferably in the range of from 3 to 300 pbw per 100 pbw of carrier material, more preferably from 10 to 80 pbw, especially from 20 to 60 pbw.

If desired, the catalyst may also comprise one or more metals or metal oxides as promoters. Suitable metal oxide promoters may be selected from Groups IIA, IIIB, IVB, VB and VIB of the Periodic Table of Elements, or the actinides and lanthanides. In particular, oxides of magnesium, calcium, strontium, barium, scandium, yttrium, lanthanum, cerium, titanium, zirconium, hafnium, thorium, uranium, vanadium, chromium and manganese are very suitable promoters. Particularly preferred metal oxide promoters for the catalyst used to prepare the waxes for use in the present invention are manganese and zirconium oxide. Suitable metal promoters may be selected from Groups VIIB or VIII of the Periodic Table. Rhenium and Group VIII noble metals are particularly suitable, with platinum and palladium being especially preferred. The amount of promoter present in the catalyst is suitably in the range of from 0.01 to 100 pbw, preferably 0.1 to 40, more preferably 1 to 20 pbw, per 100 pbw of carrier. The most preferred promoters are selected from vanadium, manganese, rhenium, zirconium and platinum.

The catalytically active metal and the promoter, if present, may be deposited on the carrier material by any suitable treatment, such as impregnation, kneading and extrusion. After deposition of the metal and, if appropriate, the promoter on the carrier material, the loaded carrier is typically subjected to calcination. The effect of the calcination treatment is to remove crystal water, to decompose volatile decomposition products and to convert organic and inorganic compounds to their respective oxides. After calcination, the resulting catalyst may be activated by contacting the catalyst with hydrogen or a hydrogen-containing gas, typically at temperatures of about 200 to 350° C. Other processes for the preparation of Fischer-Tropsch catalysts comprise kneading/mulling, often followed by extrusion, drying/calcination and activation.

The catalytic conversion process may be performed under conventional synthesis conditions known in the art. Typically, the catalytic conversion may be effected at a temperature in the range of from 150 to 300° C., preferably from 180 to 260° C. Typical total pressures for the catalytic conversion process are in the range of from 1 to 200 bar absolute, more preferably from 10 to 70 bar absolute. In the catalytic conversion process especially more than 75 wt % of $C_5$+, preferably more than 85 wt % $C_5$+ hydrocarbons are formed. Depending on the catalyst and the conversion conditions, the amount of heavy wax (C20+) may be up to 60 wt %, sometimes up to 70 wt %, and sometimes even up till 85 wt %. Preferably a cobalt catalyst is used, a low $H_2/CO$ ratio is used (especially 1.7, or even lower) and a low temperature is used (190–240° C.), optionally in combination with a high pressure. To avoid any coke formation, it is preferred to use an $H_2/CO$ ratio of at least 0.3. It is especially preferred to carry out the Fischer-Tropsch reaction under such conditions that the ASF-alpha value (Anderson-Schulz- Flory chain growth factor), for the obtained products having at least 20 carbon atoms, is at least 0.925, preferably at least 0.935, more preferably at least 0.945, even more preferably at least 0.955. Preferably the Fischer-Tropsch hydrocarbons stream comprises at least 40 wt % $C_{30}$+, preferably 50 wt %, more preferably 55 wt %, and the weight ratio $C_{60}$+/$C_{30}$+ is at least 0.35, preferably 0.45, more preferably 0.55.

Preferably, a Fischer-Tropsch catalyst is used, which yields substantial quantities of paraffins, more preferably substantially unbranched paraffins. A most suitable catalyst for this purpose is a cobalt-containing Fischer-Tropsch catalyst. Such catalysts are described in the literature, see e.g. AU 698392 and WO 99/34917 both are hereby incorporated by reference.

The Fischer-Tropsch process may be a slurry FT process or a fixed bed FT process, especially a multitubular fixed bed.

The term "middle distillates", as used herein, is a reference to hydrocarbon mixtures of which the boiling point range corresponds substantially to that of kerosene and diesel fractions obtained in a conventional atmospheric distillation of crude mineral oil.

Any normally liquid Fischer-Tropsch hydrocarbons mentioned in the present description are in general $C_{5-18}$ hydrocarbons or mixtures thereof, although certain amounts of $C_4$− or $C_{19}$+ hydrocarbons may be present. These hydrocarbons or mixtures thereof are liquid at temperatures between 5 and 30° C. (1 bar), especially at 20° C. (1 bar), and are paraffinic of nature, although considerable amounts of olefins and/or oxygenates may be present. Suitably up to 20 wt %, preferably up to 10 wt %, of either olefins or oxygenated compounds may be present. Any heavy Fischer-Tropsch wax comprises all hydrocarbons or mixtures thereof which are solid at 20° C., especially $C_{18-300}$, more especially $C_{19-250}$. Any normally gaseous Fischer-Tropsch hydrocarbons are $C_1$ to $C_4$ hydrocarbons, although small amounts of $C_5$+ may be present.

The Fischer-Tropsch step of the present process is followed by a step in which at least part of the heavy paraffins-containing hydrocarbon mixture produced in the first step is hydrocracked and hydroisomerized. In this step a catalyst is used which preferably contains a catalytically active metal component as well as an acidic function. The metal component can be deposited on any acid carrier having cracking and isomerisation activity, for example a halogenated (e.g. fluorided or chlorided) alumina or zeolitic carrier or an amorphous silica/alumina carrier.

The catalyst used in the hydrocracking/hydroisomerising step of the process according to the invention may contain as catalytically active metal components one or more metals selected from Groups VIB, VIIB and/or VIII of the Periodic System. Examples of such metals are molybdenum, tungsten, rhenium, the metals of the iron group and the metals of the platinum and palladium groups. Catalysts with a noble metal as catalytically active metal component generally contain 0.05–5 parts by weight and preferably 0.1–2 parts by weight of metal per 100 parts by weight of carrier material. Very suitable noble metals are palladium and platinum. Catalysts with a non-noble metal or a combination of non-noble metals as catalytically active metal component generally contain 0.1–35 parts by weight of metal or combination of metals per 100 parts by weight of carrier material. Very suitable hydrocracking catalysts contain a combination of 0.5–20 parts by weight and in particular 1–10 parts by weight of a non-noble metal of Group VIII and 1–30 parts by weight and in particular 2–20 parts by weight of a metal of Group VIB and/or VIIB per 100 parts by weight of carrier material. Particularly suitable metal combinations are combinations of nickel and/or cobalt with tungsten and/or molybdenum and/or rhenium. Likewise very suitable as hydrocracking catalysts are catalysts which contain 0.1–35 parts by weight and in particular 1–15 parts by weight of nickel per 100 parts by weight of carrier material.

If the present hydrocracking catalysts contain a non-noble metal or combination of non-noble metals as catalytically active metal component, they are preferably used in their sulphidic form. The conversion of the hydrocracking catalysts to their sulphidic form can very suitably be carried out by contacting the catalysts at a temperature below 500° C. with a mixture of hydrogen and hydrogen sulphide in a volume ratio of 5:1 to 15:1. The conversion of the catalysts into the sulphidic form may also be carried out by adding to the feed, under reaction conditions, sulphur compounds in a quantity of from 10 ppmw to 5% by weight and in particular in a quantity of from 100 ppmw to 2.5% by weight.

The isomerisation/hydrocracking step (2) or (5) of the present process may be carried out using a catalyst comprising a zeolite having a pore diameter in the range from 0.5 to 1.5 Å. The silica:alumina ratio of the zeolite is preferably in the range from 5 to 200. A very suitable carrier is a mixture of two refractory oxides, especially an amorphous composition as amorphous silica/alumina.

The metals can be applied to the carrier in any conventional manner such as by impregnation, percolation or ion exchange. After the catalytically active metal components have been applied to the carrier, the catalyst is usually dried and subsequently calcined. Hydroconversion catalysts are usually employed in the form of particles with a diameter of 0.5–5 mm. However, zeolites suitable for use as carrier material for the present hydroconversion catalysts are often available as a fine powder. The zeolites may be shaped into particles of larger dimensions, for example, by compression and extrusion. During shaping the zeolite may, if desired, be combined with an inorganic matrix or binder. Examples of suitable matrices or binders are natural clays and synthetic inorganic oxides.

Suitable conditions for the hydrocracking/isomerisation step (1) of the heavy paraffins-containing hydrocarbon mixture according to the process according to the invention are a temperature of 280–400° C., preferably 290–375° C., more preferably 300–350° C., a pressure between 15 and 200 bar, preferably 20–80 bar, more preferably between 20–50 bar, an hourly space velocity of 0.2–20 kg of hydrocarbon feed per kg of catalyst per hour, preferably between 0.5 and 3 kg/h, more preferably between 1 and 2.5 kg/h, and a hydrogen/hydrocarbon feed molar ratio of 1–50.

The hydrocracking/isomerisation step (1) is preferably carried out in such a way that the conversion per pass of the material boiling above 370° C. (feed plus recycle) into material boiling below 370° C. is between 30 and 70 wt %, preferably between 40 and 60 wt %, more preferably about 50 wt %.

Suitably at least part the full product of the Fischer-Tropsch reaction is separated into a light product stream, the light stream preferably comprising all components boiling below the kero/diesel boiling range, and a heavy Fischer-Tropsch hydrocarbons stream, which stream is used in step (1). The light products stream comprises at least unreacted synthesis gas, carbon dioxide, inert gasses as nitrogen and steam, and at least part of the hydrocarbons formed in the Fischer-Tropsch reaction, preferably the $C_1$–$C_{10}$ hydrocarbons, preferably the $C_1$–$C_4$ hydrocarbons. The heavy Fischer-Tropsch hydrocarbons stream comprises at least all components boiling above the kero/diesel boiling range, but preferably also the components boiling in the kero/diesel boiling range, as this improves the properties, especially the cold flow properties, of the product. Depending on the use of the product boiling below the kero/diesel boiling range, it may be advantageous or not to have it incorporated in the heavy Fischer-Tropsch stream. For instance, when it is the intention to use it as a component for gasoline, it is preferred to give it a hydrocracking/hydroisomerisation treatment to improve the octane number. In the case that it is to be used as ethylene cracker feedstock, it is preferred to avoid any hydrocracking/hydroisomerisation.

Advantageously at least part of the effluent of the isomerisation/hydrocracking step is passed to a separation step in which a hydrogen-containing gas and a hydrocarbon effluent are separated from each other. Suitably, in this separation step a hydrogen-containing gas and a hydrocarbon effluent are separated off by flash distillation. Suitably the flash distillation is carried out at a temperature between −20 and 100° C., and a pressure between 1 and 50 bar. Suitably the hydrocarbon fraction is separated into a fraction boiling above 370° C. and one or more fractions boiling below 370° C., e.g. two or three fractions boiling in the (light and heavy) gas oil range and a kerosene fraction. At least part of the heavy fraction obtained in the first hydrocracking/hydroisomerisation reaction is introduced in the second hydrocracking/hydroisomerisation reaction. Especially a substantial part of the 370° C. fraction is introduced in the second reaction, but also substantial parts of the kerosene/gas oil fraction may be introduced into this second step. Suitably at least 50 wt % of the 370° C. is introduced into the second hydrocracking/hydroisomerisation step, preferably 70 wt %, more preferably at least 90 wt %, especially the total 370° C. plus fraction is introduced into the second step.

The conditions (catalyst, temperature, pressure, WHSV etc.) of the second hydrocracking/hydroisomerisation reaction are suitably similar to the first reaction, although this is not necessarily the case. The conditions and the preferred conditions are described above for the first reaction. In a preferred situation the conditions in the first and the second hydrocracking/hydroisomerisation are the same.

Work-up of the products of the second hydrocracking/hydroisomerisation reaction is suitably similar to the first reaction (see above), although this is not necessarily the case. In a preferred embodiment steps (2) and (4) are combined, i.e. the same distillation unit is used to produce the fuel products boiling in the kero/diesel range produced in steps (1) and (3).

At least part of the heavy fraction obtained in the second hydrocracking/hydroisomerisation reaction is introduced in the first or second hydrocracking/hydroisomerisation reaction. Suitably at least 30 wt % of the fraction boiling above 370° C. is introduced into the first hydrocracking/hydroisomerisation step, preferably 60 wt %, more preferably at least 90 wt %, especially the total 370° C. plus fraction is introduced into the second step. The remaining part of the fraction boiling above 370° C. may be used for different purposes, e.g. for the preparation of base oils, but is preferably recycled to the first hydrocracking/hydroisomerisation step.

In a preferred embodiment of the invention, the first and second hydrocracking/hydroisomerisation reaction are combined into one reaction step. This results in a very simple scheme, comprising one hydrocracking/isomerisation step and one separation step only. In that case at least part of the fraction boiling above 370° C. is recycled to the combined hydrocracking/hydroisomerisation step, suitably at least 30 wt %, preferably at least 60 wt %, more preferably at least 90 wt %. The conversion per pass (of the fraction boiling above 370° C. (feed plus recycle)) is suitably between 30 and 70 wt %, preferably between 40 and 65 wt % (based on total feed supplied to the hydrocracking/hydroisomerisation step).

In a preferred embodiment of the present invention, the amount of heavy fraction obtained in step 2 which is used in step (3) or used in step (3) and recycled to step (1), is at least 70 wt %, preferably 85 wt %, more preferably 95 wt % of the total heavy fraction (i.e. boiling above 370° C.). In another preferred embodiment the amount of heavy fraction obtained in step (4) which is used for step (1) and/or step (3), is at least 70 wt %, preferably 85 wt %, more preferably 95 wt % of the total heavy fraction.

The invention further relates to hydrocarbon products boiling on the kero/diesel boiling range obtainable by a process as defined above. The invention especially relates to a hydrocarbon fuel product, which has not been subjected to an additional dewaxing treatment, boiling in the diesel boiling range (defined above) having the following properties: cetane number at least 50, preferably at least 60, more preferably at least 70, suitably up to 80, or even up to 90, iso/normal ratio between 2.5 and 10, especially between 3.5 and 6, more especially between 4 and 5, the amount of mono-iso compounds being at least 70 wt % (based on total product boiling in the diesel range), preferably 75 wt %, more preferably 75–85%, cloud point below −10° C., preferably −20° C. (in general up to −36° C.), CFPP below −20° C., preferably below −28° C. (in general up to −44° C.) pour point below −15° C. and preferably below −22° C. (in general up to −40° C.). Preferably the hydrocarbon product as described above in which the amount of dimethyl compounds is between 23 and 28 wt % (based on total product boiling in the diesel range). The products obtained in step (4) of the process according to the present invention are preferred, as these products show extremely good cold flow properties, i.e. cloud points below −26° C., CFPP below −30° C. and pour points below −24° C.

The invention is illustrated by the following non-limiting example.

EXAMPLE 1

A Fischer-Tropsch product was prepared in a process similar to the process as described in Example VII of WO-A-9934917 hereby incorporated by reference, using the catalyst of Example III of WO-A-9934917 hereby incorporated by reference. The $C_5$+ fraction of the product thus obtained was continuously fed to a hydrocracking step (step (a)). The $C_5$+ fraction contained about 60 wt % $C30_+$ product. The ratio $C_{60}$+/$C_{30}$+ was about 0.55. In the hydrocracking step the fraction was contacted with a hydrocracking catalyst of Example 1 of EP-A-532118 hereby incorporated by reference. The effluent of step (a) was continuously distilled under vacuum to give light products, fuels and a residue "R" boiling from 370° C. and above. The conversion of the product boiling above 370° C. into product boiling below 370° C. was between 45 and 55 wt %. The residue "R" was recycled to step (a). The conditions in the hydrocracking step (a) were: a fresh feed Weight Hourly Space Velocity (WHSV) of 0.8 kg/l.h, recycle feed WHSV of 0.4 kg/l.h, hydrogen gas rate=1000 Nl/kg, total pressure=40 bar, and a reactor temperature of 330° C., 335° C. or 340° C. A comparison example was carried out with Fischer Tropsch material made with a cobalt/zirconia/silica catalyst as described in EP 426223 hereby incorporated by reference using conditions similar to the conditions as described above. The $C_5$+ fraction contained about 30 wt % $C_{30}$+ product, the ratio $C_{60}$+/$C_{30}$+ was 0.19. The properties of the diesel fuel fractions are summarized in the Table. Experiments I, II and III are according to the invention, Experiments IV and V are comparison experiments. The temperatures mentioned in the Table are the temperatures of the hydrocracking step. Cloud point, Pour point and CFPP were determined by ASTM D2500, ASTM D97 and IP 309-96. Establishment of the $C_5$+, $C_{30}$+ and $C_{60}$+ fractions were done by gas chromatography.

TABLE

| | Experiment | | | | |
|---|---|---|---|---|---|
| | I | II | III | IV | V |
| Temperature | 330 | 335 | 340 | 330 | 335 |
| Cloud Point | −13 | −20 | <−24 | +1 | −2 |
| CFPP | −14 | −21 | −28 | 0 | −5 |
| Pour Point | −18 | <−24 | <−24 | 0 | −6 |
| Normals (wt %) | 27.6 | 21.3 | 19.9 | 50.4 | 41.2 |
| Iso's (wt %) | 72.4 | 78.7 | 80.1 | 49.6 | 58.8 |
| Mono-methyl | 37.3 | 39.5 | 39.5 | 29.2 | 32.2 |
| Di-methyl | 21.7 | 25.5 | 26.7 | 13.9 | 18.1 |
| Others | 13.4 | 13.8 | 14.1 | 6.4 | 8.5 |
| Density (kg/l) | 0.78 | 0.78 | 0.78 | 0.78 | 0.78 |
| Cetane (D976m) | 78 | 77 | 76 | 80 | 78 |
| Cetane (D4737m) | 87 | 85 | 86 | 90 | 85 |
| T95 | 363 | 360 | 358 | — | — |

We claim:

1. A process for the preparation of one or more hydrocarbon fuel products boiling in the kero/diesel range from a stream of hydrocarbons produced in a Fischer Tropsch process comprising converting synthesis gas into liquid hydrocarbons, at least a part of the hydrocarbons boiling above the kero/diesel range, comprising the following steps:

(1) hydrocracking/hydroisomerizing at least a part of the Fischer Tropsch hydrocarbons stream at a conversion per pass of at most 80 wt % of the material boiling above 370° C. into material boiling below 370° C.;

(2) separating the product stream obtained in step (1) into one or more light fractions boiling below the kero/diesel boiling range, one or more fractions boiling in the kero/diesel boiling range and a heavy fraction boiling above the kero/diesel boiling range;

(3) hydrocracking/hydroisomerizing a major part of the heavy fraction obtained in step (2) at a conversion per pass of at most 80 wt % of the material boiling above 370° C. into a product stream of material boiling below 370° C.;

(4) separating the product stream obtained in step (3) into one or more light fractions boiling below the kero/diesel boiling range, one or more fractions boiling in the kero/diesel boiling range and a heavy fraction boiling above the kero/diesel boiling range; and, (5) hydrocracking/hydroisomerizing a major part of the heavy fraction obtained in step (4) in the hydrocracking/hydroisomerizing process described in step (1) and/or step (3), in which process the Fischer Tropsch hydrocarbons stream comprises at least 35 wt % $C_{30}$+ (based on total amount of hydrocarbons in the Fischer Tropsch hydrocarbons stream) and in which stream a weight ratio $C_{30}$+/$C_{60}$+ is at least 0.2.

2. The process of claim 1, wherein the Fischer Tropsch process further comprises converting synthesis gas into liquid hydrocarbons over an iron or cobalt catalyst.

3. The process of claim 2, wherein the catalyst comprises a cobalt catalyst comprising a carrier; and, optionally one or more promoters selected from the group consisting of vanadium, manganese, rhenium, zirconium and platinum.

4. The process of claim 1, wherein the Fischer Tropsch process further comprises conditions such that the Anderson-Schulz-Flory alpha value for the obtained products having at least 20 carbon atoms is at least 0.925.

5. The process of claim 1, wherein the Fischer Tropsch process comprises a slurry Fischer Tropsch process or a fixed bed Fischer Tropsch process.

6. The process of claim 1, wherein at least part of the full product of the Fischer Tropsch reaction is separated into a light product stream,,; and, a heavy Fischer Tropsch hydrocarbons stream, which stream is used in step (1).

7. The process of claim 6, wherein the light products stream comprises unreacted synthesis gas, carbon dioxide, inert gases such as nitrogen and steam, and $C_1$–$C_4$ hydrocarbons.

8. The process of claim 1 wherein the Fischer Tropsch hydrocarbons stream comprises at least 40 wt % $C_{30}$+ hydrocarbons, based on total hydrocarbons stream.

9. The process of claim 1 wherein the product boiling in the kero/diesel boiling range has a boiling range within the range of 110° C. and 400° C.

10. The process of claim 1 wherein the conversion per pass in steps (1) and/or (3) of the material boiling above 370° C. into material boiling below 370° C. is between 30 wt % and 70 wt.

11. The process of claim 1 wherein the first hydrocracking/hydroisomerization step is carried out at a temperature between 290° C. and 375° C., a pressure between 15 and 200 bar and a WHSV between 0.5 and 3 kg/l/h.

12. The process of claim 1 wherein the second hydrocracking/hydroisomerisation step is carried out at a temperature between 290° C. and 375° C., a pressure between 15 and 200 bar, and a WHSV between 0.5 and 3 kg/l/h.

13. The process of claim 12, wherein in the second hydrocracking/hydroisomerization step the same conditions are used as in the first hydrocracking/hydroisomerization step.

14. The process of claim 1 wherein a part of the heavy boiling fraction obtained in step (2) which fraction is not introduced in the process of step (3), is recycled to step (1).

15. The process of claim 13, wherein the first and the second hydrocracking/hydroisomerization step are combined in the same reactor.

16. The process of claim 1 wherein the amount of heavy fraction obtained in step (2) which is used in step (3) or used in step (3) and recycled to step (1), is at least 70 wt of the total heavy fraction.

17. The process of claim 1 wherein the amount of heavy fraction obtained in step (4) which is used for step (2) in step (1) and/or step (3), is at least 70 wt % of the total heavy fraction.

* * * * *

UNITED STATES PATENT AND TRADEMARK OFFICE

CERTIFICATE OF CORRECTION

PATENT NO. : 6,858,127 B2
APPLICATION NO. : 10/469843
DATED : February 22, 2005
INVENTOR(S) : Hoek et al.

It is certified that error appears in the above-identified patent and that said Letters Patent is hereby corrected as shown below:

Claim 1, line 53, change "$C_{30}$+/$C_{60}$+" to --$C_{60}$+/$C_{30}$+--

Signed and Sealed this

Ninth Day of January, 2007

JON W. DUDAS
*Director of the United States Patent and Trademark Office*